US005700152A

United States Patent [19]

Niedzwiecki

[11] Patent Number: 5,700,152

[45] Date of Patent: Dec. 23, 1997

[54] ELECTRICAL TERMINAL APPARATUS

[75] Inventor: Leon P. Niedzwiecki, Romeo, Mich.

[73] Assignee: TRW Vehicle Safety Systems Inc., Lyndhurst, Ohio

[21] Appl. No.: 688,302

[22] Filed: Jul. 30, 1996

[51] Int. Cl.[6] ..... H01R 9/09

[52] U.S. Cl. ..... 439/78; 439/82

[58] Field of Search ..... 439/82, 78, 55, 439/73, 329, 493, 56

[56] References Cited

U.S. PATENT DOCUMENTS

| | | | |
|---|---|---|---|
| 3,953,103 | 4/1976 | Mathis | 439/866 |
| 3,963,316 | 6/1976 | Williams | 439/82 |
| 4,274,702 | 6/1981 | Buck et al. | 439/589 |
| 4,784,613 | 11/1988 | Deisch | 439/493 |
| 5,129,829 | 7/1992 | Arnold et al. | 439/56 |
| 5,366,381 | 11/1994 | Kile | 439/79 |
| 5,411,409 | 5/1995 | Gray et al. | 439/329 |
| 5,509,814 | 4/1996 | Mosquera | 439/82 |

*Primary Examiner*—P. Austin Bradley
*Assistant Examiner*—Tho Dac Ta
*Attorney, Agent, or Firm*—Tarolli, Sundheim, Covell, Tummino & Szabo

[57] ABSTRACT

An electrical apparatus (10) includes a circuit board (12) having an opening (40). A conductor terminal (30) is secured on an electrical conductor (20). An axis (116) of the conductor terminal (30) extends through the opening (40) in the circuit board (12). A first portion (112) of the conductor terminal (30) is located in the opening (40) in the circuit board (12). A second portion (114) of the conductor terminal (30) extends transverse to the axis (116) and is electrically connected to the circuit board (12). A portion of the circuit board (12) overlies a surface (122) on the second portion (114) of the conductor terminal (30) to block movement of the conductor terminal (30) in a direction parallel to the axis (116). A strain relief tab (140) on the conductor terminal (30) engages a surface (82) on a housing (14) to block movement of the conductor terminal relative to the circuit board (12) in a direction transverse to the axis (116).

13 Claims, 2 Drawing Sheets

ELECTRICAL TERMINAL APPARATUS

BACKGROUND OF THE INVENTION

1. Technical Field

The present invention relates to the connection of an electrical conductor to a circuit board.

2. Description of the Prior Art

A typical circuit board includes a plurality of electronic components which are mounted on the circuit board and which are electrically interconnected by conductive traces on the circuit board. An electrical conductor is used for connecting the circuit board with a device external to the circuit board. The electrical conductor has a terminal connected with one of the conductive traces on the circuit board. Solder is applied to the conductor terminal and to the one conductive trace to form both an electrical connection and a mechanical connection between the terminal and the conductive trace on the circuit board.

Mechanical forces applied to the conductor are transmitted to the terminal and thence to the solder connection. These forces can tend to weaken the mechanical connection and the electrical connection between the conductor terminal and the circuit board.

SUMMARY OF THE INVENTION

The present invention is an apparatus comprising a circuit board, an electrical conductor, and a conductor terminal on the electrical conductor. A first portion of the conductor terminal is located in an opening in the circuit board. The first portion of the conductor terminal has a longitudinal axis extending through the opening. A second portion of the conductor terminal extends transverse to the longitudinal axis and is electrically connected with the circuit board. The circuit board has a portion which overlies the second portion of the conductor terminal to block movement of the conductor terminal in a direction parallel to the longitudinal axis. The apparatus further includes means for blocking movement of the conductor terminal relative to the circuit board in a direction transverse to the longitudinal axis.

BRIEF DESCRIPTION OF THE DRAWINGS

Further features and advantages of the present invention will become apparent to those skilled in the art to which the present invention relates from reading the following specification with reference to the accompanying drawings, in which.

DESCRIPTION OF PREFERRED EMBODIMENTS

Figure 1:
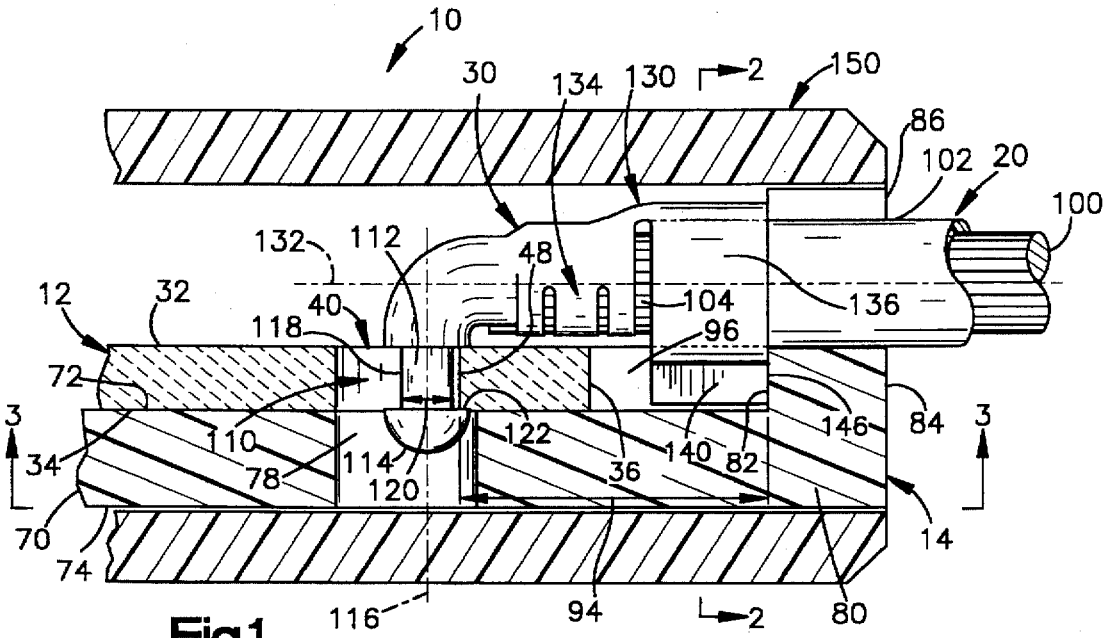
FIG. 1 is a sectional view of portions of an electrical apparatus which is constructed in accordance with a first embodiment of the present invention.

The present invention relates to the connection of an electrical conductor to a circuit board. As representative of the present invention, FIG. 1 illustrates an electrical apparatus 10 which may be, for example, a switch which is part of the electric circuitry of a vehicle. The electrical apparatus 10 includes a circuit board 12 mounted in a housing 14. One or more electronic components (not shown) are mounted on the circuit board. An electrical conductor 20 extends between and provides an electrical connection between the circuit board 12 and an electrical device (not shown) external to the circuit board. A conductor terminal 30, on the electrical conductor 20, provides both an electrical connection and a mechanical connection between the electrical conductor and the circuit board 12.

Figure 3:
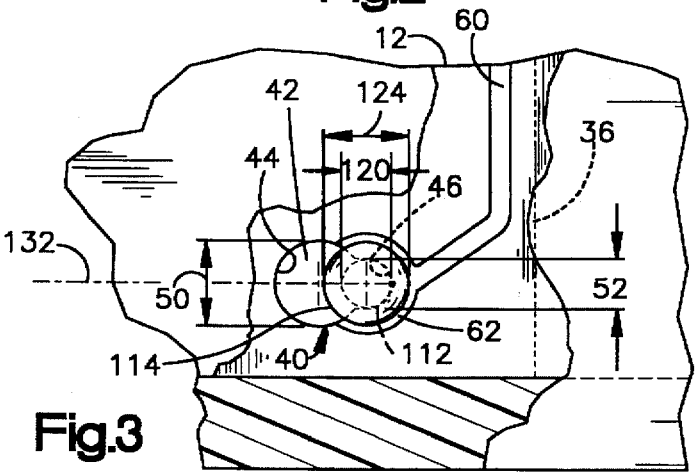
FIG. 3 is a sectional view taken generally along line 3—3 of FIG. 1.

The circuit board 12 has an upper side surface 32 (as viewed in FIG. 1) and a lower side surface 34. The side surfaces 32 and 34 extend generally parallel to each other and are interconnected by end surfaces including one end surface which is designated 36. An opening 40 extends through the circuit board 12 between the upper surface 32 and the lower surface 34. The opening 40 has an insertion portion 42 (FIG. 3) which is defined by a cylindrical side surface 44. The insertion portion 42 of the opening 40 has a first width or diameter as indicated by the arrow 50 (FIG. 3).

The opening 40 also has an attachment portion 46 which partially overlaps the insertion portion 42. The attachment portion 46 of the opening 40 is defined by a cylindrical side surface 48 (FIG. 1). The attachment portion 46 of the opening 40 has a second width or diameter, as indicated by the arrow 52 (FIG. 3). The diameter 52 of the attachment portion 46 of the opening 40 is substantially less than the diameter 50 of the insertion portion 42 of the opening.

A plurality of conductive traces on the lower surface 34 of the circuit board 12, including one particular conductive trace 60 (FIG. 3), electrically interconnect the electrical components on the circuit board. An annular portion 62 of the one conductive trace 60 extends around the perimeter of the attachment portion 46 of the opening 40 in the circuit board 12.

The housing 14 (FIG. 1) includes a base portion 70. The base portion 70 of the housing 14 has an upper (as viewed in FIG. 1) surface 72 and an opposite lower surface 74. An opening 78 extends through the base portion 70 of the housing 14 between the upper surface 72 of the base portion and the lower surface 74. A side wall 80 of the housing 14 has an inner side surface 82 and an outer side surface 84. An opening 86 extends through the side wall 80 of the housing 14 between the inner side surface 82 and the outer side surface 84 of the side wall.

The circuit board 12 is fixed to the housing 14 by suitable fastening means (not shown). The lower surface 34 of the circuit board 12 is disposed on the upper surface 72 of the base portion 70 of the housing. The surface 48 (FIG. 1) on the circuit board 12, which defines the attachment portion 46 of the opening 40, is spaced apart from the inner side surface 82 on the housing side wall 80 by a predetermined distance indicated by the arrow 94. The surfaces 36 and 82 define an opening 96 in the apparatus 10. The opening 40 in the circuit board 12 overlies a portion of the opening 78 in the base portion 70 of the housing 14. The opening 78 in the housing 14 has a larger cross-sectional area than the opening 40 in the circuit board 12.

The electrical conductor 20 (FIG. 1) includes an electrically conductive wire 100. An electrically insulating jacket 102 overlies the conductive wire 100. An end portion 104 of the conductive wire 100 is not covered by the insulating jacket 102. An opposite end portion (not shown) of the electrical conductor 20 is connectable with a device external to the circuit board 12 to establish an electrical connection between the device and the circuit board.

The conductor terminal 30 (FIG. 1) includes a connector section 110 for engagement with the circuit board 12. The connector section 110 has a mushroom-shaped configuration including a cylindrical neck portion 112 and a hemispherical head portion 114. The connector section 110 has a longitudinal central axis 116.

The neck portion 112 of the connector section 110 of the conductor terminal 30 has a cylindrical outer side surface 118 which is centered on and extends parallel to the axis 116. The neck portion 112 has a width or diameter as indicated by the arrow 120 (FIG. 3). The diameter 120 of the neck portion 112 of the conductor terminal 30 is slightly less than the diameter 50 of the insertion portion 42 of the opening 40 and greater than the diameter 52 of the attachment portion 46 of the opening 40.

The head portion 114 of the connector section 110 of the conductor terminal 30 is located at one axial end of the neck portion 112. The head portion 114 has an annular upper surface 122 (as viewed in FIG. 1) which extends radially outward from the side surface 118 of the neck portion 112 in a direction perpendicular to the axis 116.

The head portion 114 of the connector section 110 has a width or diameter as indicated by the arrow 124 (FIG. 3). The diameter 124 of the head portion 114 of the conductor terminal 30 is greater than the diameter 120 of the neck portion 112. The diameter 124 of the head portion 114 of the conductor terminal 30 is slightly less than the diameter 50 of the insertion portion 42 of the opening 40, but is substantially greater than the diameter 52 of the attachment portion 46 of the opening.

The conductor terminal 30 also includes a main body portion 130 (FIG. 1) for connection with the electrical conductor 20. The main body portion 130 of the conductor terminal 30 has a longitudinal central axis 132 which extends perpendicular to the axis 116 of the connector section 110 of the conductor terminal.

The main body portion 130 of the conductor terminal 30 includes a wire crimp portion 134 which is crimped around the exposed end portion 104 of the conductive wire 100. The electrical conductor 20 is, as a result, electrically connected with the conductor terminal 30. Solder (not shown) may also be applied to the connection between the wire crimp portion 134 and the conductive wire 100 to improve the electrical and mechanical characteristics of the connection. An insulator crimp portion 136 of the main body portion 110 of the conductor terminal 30 is crimped around the insulating jacket 102 of the electrical conductor 20.

Figure 2:
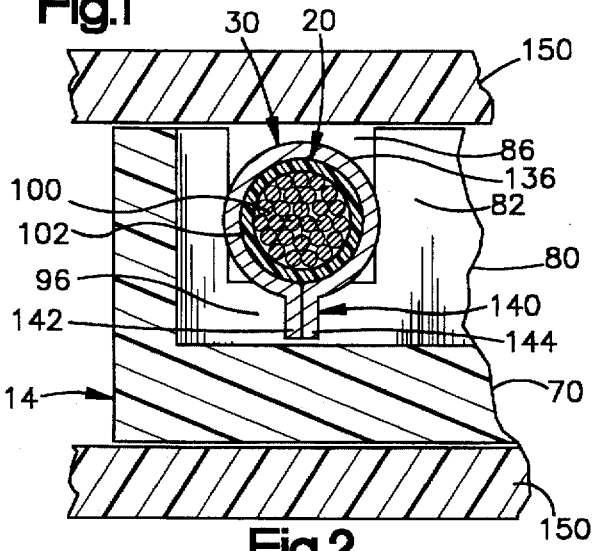
FIG. 2 is a sectional view taken generally along line 2—2 of FIG. 1.

The conductor terminal 30 includes a strain relief tab 140. The strain relief tab 140 is formed when the material of the insulator crimp portion 136 of the conductor terminal 30 is crimped around the insulating jacket 102 of the electrical conductor 20. The strain relief tab 140 includes two abutting layers 142 and 144 (FIG. 2) of the material of the conductor terminal 30. The strain relief tab 140 extends radially in a direction away from the axis 132. A radially extending side surface 146 on the strain relief tab 140 is presented away from the connector section 110 of the conductor terminal 30. The side surface 146 on the strain relief tab 140 is spaced apart from the neck portion 112 of the conductor terminal 30 by a predetermined distance which is slightly greater than the distance 94 between the surface 48 on the circuit board 12 and the inner side surface 82 on the housing 14.

The electrical apparatus 10 also includes a collar indicated schematically at 150. The collar 150 is loosely fitted over the electrical conductor 20 prior to assembly of the apparatus 10. The collar 150 is moved into a position surrounding the circuit board 12, as shown in FIG. 1, only after the conductor terminal 30 is connected with the circuit board 12 as described below.

To connect the electrical conductor 20 with the circuit board 12, the conductor terminal 30 is inserted, in a direction to the left as viewed in FIG. 1, through the opening 86 in the side wall 80 of the housing 14. The connector section 110 of the conductor terminal 30 is positioned over the insertion portion 42 of the opening 40 in the circuit board 20. When the conductor terminal 30 is in this position, the strain relief tab 140 is disposed over the lefthand portion (as viewed in FIG. 1) of the opening 96 between the end surface 36 of the circuit board 12 and the inner side surface 82 on the side wall 80 of the housing 14.

The connector section 110 of the conductor terminal 30 is then moved in a direction parallel to the axis 116 (downward as viewed in FIG. 1) into the insertion portion 42 of the opening 40 in the circuit board 12. The head portion 114 of the conductor terminal 30 moves through the opening 40 in the circuit board 12 and into the opening 78 in the base portion 70 of the housing 14. The neck portion 112 of the conductor terminal 30 is disposed in the insertion portion 42 of the opening 40 in the circuit board 12. The strain relief tab 140 moves into the opening 96 between the end surface 36 of the circuit board 12 and the side surface 82 on the housing 14.

The conductor terminal 30 is, thereafter, moved in a direction parallel to the axis 132 (to the right as viewed in FIG. 1). The neck portion 112 of the connector section 110 of the conductor terminal 130 moves from the insertion portion 42 of the opening 40 into the attachment portion 46 of the opening 40 in the circuit board 22. The outer side surface 118 on the neck portion 112 of the conductor terminal 30 is disposed adjacent to, but does not engage, the side surface 48 which defines the attachment portion 46 of the opening 40 in the circuit board 12.

When the conductor terminal 30 is in this final position of assembly, the radially extending surface 122 on the head portion 114 of the conductor terminal lies in a plane which is transverse or perpendicular to the longitudinal axis 116. The lower surface 34 of the circuit board 12 overlies the head portion 114 of the conductor terminal 30. The surface 122 engages the annular portion 62 of the conductive trace 60 on the lower surface 34 of the circuit board 12. This engagement blocks movement of the conductor terminal 30, relative to the circuit board 12, in a direction parallel to the axis 116, that is, upward as viewed in FIG. 1. This engagement also effects an electrical connection between the conductor terminal 30 and the conductive trace 60 on the circuit board 12. The connector section 110 of the conductor terminal 30 is, preferably, soldered to the conductive trace 60 on the circuit board 12.

When the conductor terminal 30 is in this position, the side surface 146 of the strain relief tab 140 on the conductor terminal 30 engages the inner side surface 82 on the side wall 80 of the housing 14. This engagement blocks movement of the conductor terminal 30 relative to the circuit board 12 in a direction parallel to the axis 132 (to the right as viewed in FIG. 1). Mechanical forces, such as pull-out forces, which are applied to the electrical conductor 20, are not transmitted to the connection between the conductor terminal 30 and the circuit board 12.

After the conductor terminal 30 is connected with the circuit board 12, the collar 150 is moved lengthwise over the electrical conductor 20 into a position as shown in FIG. 1 enclosing the housing 14 and the conductor terminal 30. The collar 150 snaps onto the housing 14. The collar 150, in a manner not shown, grips the insulating jacket 102 of the electrical conductor 20 to prevent the electrical conductor and, thereby, the conductor terminal 30, from being pushed farther into the housing 14 (in a direction to the left as viewed in FIG. 1).

Figure 4:
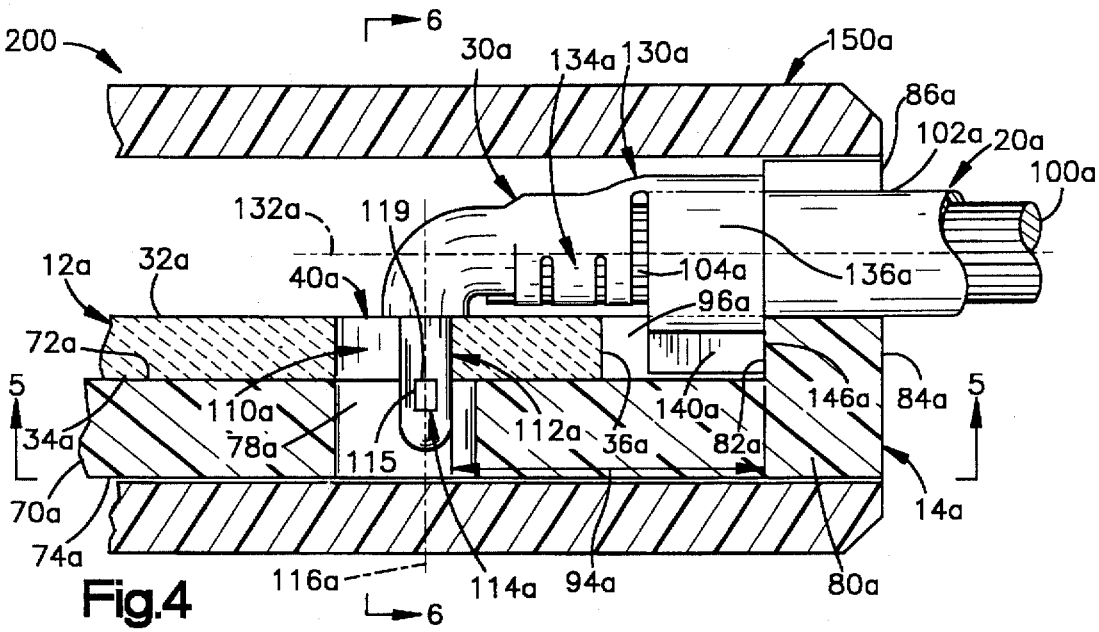
FIG. 4 is a sectional view similar to FIG. 1 of portions of an apparatus which is constructed in accordance with a second embodiment of the present invention.
Figure 5:
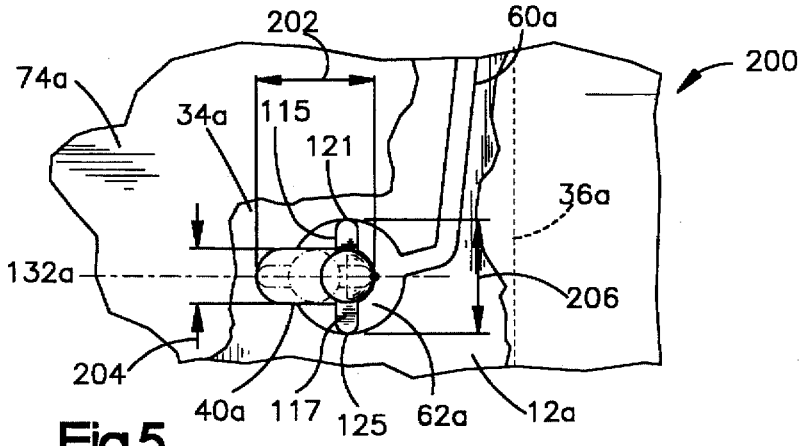
FIG. 5 is a sectional view taken generally along line 5—5 of FIG. 4.
Figure 6:
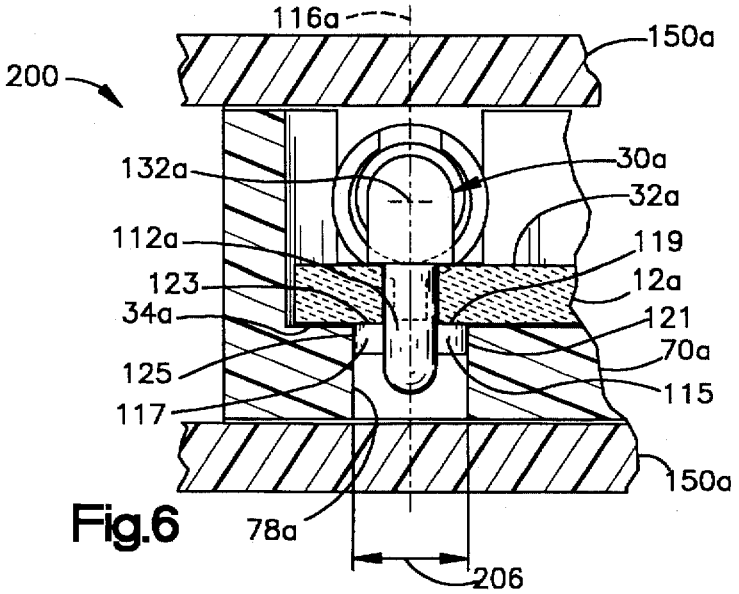
FIG. 6 is a sectional view taken generally along line 6—6 of FIG. 4.

FIGS. 4–6 illustrate portions of an electrical apparatus 200 which is constructed in accordance with a second embodiment of the present invention. The electrical apparatus 200 is generally similar to the electrical apparatus 10 (FIGS. 1–3), and similar or identical parts are given the same reference numerals with the suffix "a" added for clarity.

In the apparatus 200, an opening 40*a* in a circuit board 12*a* has an elongate, oval configuration. The length 202 (FIG. 5) of the opening 40*a*, as measured in a first direction extending between the opening and the side wall 80*a* of a housing 14*a*, is greater than the width 204 of the opening as measured in a second direction perpendicular to the first direction.

A connector section 110*a* of a conductor terminal 30*a* includes a cylindrical neck portion 112*a* which is centered on an axis 116*a*. A head portion 114*a* (FIGS. 4–6) of the conductor terminal 30*a* comprises a pair of wings 115 and 117 which extend radially outward from the neck section 112*a* in a direction transverse to the axis 116*a*. The one wing 115 has a radially extending engaging surface 119 and an end surface 121. The other wing 117 has a radially extending engaging surface 123 and an end surface 125. The distance 206 (FIG. 5) between the end surfaces 121 and 125 of the wings 115 and 117, respectively, is greater than the width 204 of the opening 40*a* in the circuit board 12*a* but is less than the length 202 of the opening 40*a*.

In assembly of the apparatus 200, the conductor terminal 30*a* is first positioned over the opening 40*a* in the circuit board 12*a*, in an orientation as shown in dot dash lines in FIG. 5. The wings 115 and 117 of the connector section 110*a* extend parallel to the long sides of the opening 40*a*.

The conductor terminal 30*a* is then moved in a downward direction as viewed in FIG. 4 so that the neck portion 112*a* of the conductor terminal is disposed in the opening 40*a* in the circuit board 12*a*. The wings 115 and 117 are disposed in the opening 78*a* in the housing 14*a*, beneath the circuit board 12*a*.

The conductor terminal 30*a* is then rotated about the axis 116*a*, in a plane parallel to the plane of the circuit board 12*a*, so that the wings 115 and 117 extend in a direction generally perpendicular to the long sides of the opening 40*a*. The wings 115 and 117 are in a position as shown in solid lines in FIG. 5. The lower surface 34*a* of the circuit board 12*a* overlies the engaging surfaces 119 and 123 on the wings 115 and 117, respectively.

The conductor terminal 30*a* is then moved, in a direction to the right as viewed in FIG. 5, to the position shown in solid lines in FIG. 5. The engaging surfaces 119 and 123 of the conductor terminal engage a conductive trace 60*a* on the lower surface 34*a* of the circuit board 12*a*. This engagement blocks movement of the conductor terminal 30*a*, relative to the circuit board 12*a*, in a direction parallel to the axis 116*a* (upward as viewed in FIG. 1). This engagement also effects an electrical connection between the conductor terminal 30*a* and the conductive trace 60*a* on the circuit board 12*a*. The connector section 110*a* of the conductor terminal 30*a* is, preferably, soldered to the conductive trace 60*a* on the circuit board 12*a*.

When the conductor terminal 30*a* is in this position, a side surface 146*a* of a strain relief tab 140*a* on the conductor terminal engages an inner side surface 82*a* on a side wall 80*a* of the housing 14*a*. As a result, movement of the conductor terminal 30*a* relative to the circuit board 12*a* is blocked in a direction parallel to the axis 132*a* (to the right as viewed in FIG. 1). Mechanical forces, such as pull-out forces, which are applied to the electrical conductor 20*a* are not transmitted to the connection between the conductor terminal 30*a* and the circuit board 12*a*.

From the above description of the invention, those skilled in the art will perceive improvements, changes and modifications in the invention. For example, the connector section of the conductor terminal, and the opening in the circuit board, may alternatively have other shapes which permit insertion of the conductor terminal at one location and which allow movement from that location to another location within the opening to engage a surface which blocks further movement of the terminal relative to the circuit board. Such improvements, changes and modifications within the skill of the art are intended to be covered by the appended claims.

Having described the invention, I claim:

1. An apparatus comprising;

a circuit board having an opening;

an electrical conductor;

a conductor terminal on said electrical conductor for providing a mechanical connection and an electrical connection between said circuit board and said electrical conductor;

said conductor terminal having a connector section which is extensible through said opening in said circuit board, said conductor terminal having a first axis extending through said connector section and through said opening in said circuit board;

said conductor terminal having a body portion connected with said electrical conductor, said conductor terminal having a second axis extending through said body portion in a direction transverse to said first axis;

said connector section of said conductor terminal being movable in said opening, in a direction parallel to said second axis, from an insertion position to an attachment position in which said connector section is electrically connected with said circuit board;

said circuit board having a portion which overlies a surface on said connector section of said conductor terminal to block movement of said conductor terminal in a direction parallel to said first axis; and said body portion of said conductor terminal including a strain relief member for blocking movement of said conductor terminal relative to said circuit board in a direction parallel to said second axis when said connector section is in the attachment position.

2. An apparatus as set forth in claim 1 wherein said body portion of said conductor terminal extends along said electrical conductor in said direction transverse to said first axis, said strain relief member extending radially outward from said body portion in a direction awayfrom said electrical conductor and parallel to said first axis.

3. An apparatus as set forth in claim 1 wherein said strain relief member extends from said conductor terminal, in a direction parallel to said first axis, at a location spaced apart from said opening in said circuit board.

4. An apparatus as set forth in claim 1 wherein said body portion of said conductor terminal is crimped onto said electrical conductor and extends along said electrical conductor in said direction transverse to said first axis, said strain relief member extending radially outward from said body portion.

5. An apparatus comprising:

a circuit board having an opening;

an electrical conductor;

a conductor terminal on said electrical conductor;

said conductor terminal including a connector section having a first portion located in said opening in said circuit board, said first portion of said conductor terminal having a longitudinal axis extending through said opening in said circuit board;

said connector section of said conductor terminal having a second portion which extends transverse to said longitudinal axis and which is electrically connected with said circuit board;

said circuit board having a portion which overlies said second portion of said conductor terminal to block movement of said conductor terminal in a direction parallel to said longitudinal axis; and said apparatus comprising means for blocking movement of said conductor terminal relative to said circuit board in a direction transverse to said longitudinal axis;

said means for blocking movement of said conductor terminal in said direction transverse to said longitudinal axis comprising a strain relief portion of said conductor terminal which is engageable with a surface on said apparatus to block movement of said conductor terminal in said direction transverse to said longitudinal axis said conductor terminal having a body portion which is crimped onto said electrical conductor and which extends away from said connector section in said direction transverse to said longitudinal axis, said strain relief portion of said conductor terminal comprising a part of said body portion of said conductor terminal.

6. An apparatus as set forth in claim 5 wherein said body portion of said conductor terminal extends along said electrical conductor in said direction transverse to said longitudinal axis, said strain relief portion of said conductor terminal extending radially outward from said body portion in a direction away from said electrical conductor and parallel to said longitudinal axis.

7. An apparatus comprising:

a circuit board having an opening;

an electrical conductor;

a conductor terminal on said electrical conductor;

said conductor terminal including a connector section having a first portion located in said opening in said circuit board, said first portion of said conductor terminal having a longitudinal axis extending through said opening in said circuit board;

said connector section of said conductor terminal having a second portion which extends transverse to said longitudinal axis and which is electrically connected with said circuit board;

said circuit board having a portion which overlies said second portion of said conductor terminal to block movement of said conductor terminal in a direction parallel to said longitudinal axis; and said apparatus comprising means for blocking movement of said conductor terminal relative to said circuit board in a direction transverse to said longitudinal axis;

said means for blocking comprising a strain relief member which is formed as a portion of said conductor terminal and which extends from said conductor terminal, in a direction parallel to said longitudinal axis, at a location spaced apart from said opening in said circuit board.

8. An apparatus as set forth in claim 7 wherein said conductor terminal has a generally cylindrical crimp portion which is crimped onto said electrical conductor and which extends along said electrical conductor in said direction transverse to said longitudinal axis, said strain relief member extending outward from said crimp portion.

9. An apparatus comprising:

a circuit board having an opening;

an electrical conductor;

an electrically conductive conductor terminal on said electrical conductor;

said conductor terminal including an electrically conductive connector section having a first portion located in said opening in said circuit board, said first portion of said conductor terminal having a longitudinal axis extending through said opening in said circuit board;

said connector section of said conductor terminal having a second portion which extends transverse to said longitudinal axis and which is electrically connected with said circuit board;

said circuit board having a portion which overlies said second portion of said conductor terminal to block movement of said conductor terminal in a direction parallel to said longitudinal axis; and means for blocking movement of said conductor terminal relative to said circuit board in a direction transverse to said longitudinal axis;

said means for blocking movement of said conductor terminal in said direction transverse to said longitudinal axis comprising a strain relief portion of said conductor terminal which is engageable with a surface on said apparatus to block movement of said conductor terminal in said direction transverse to said longitudinal axis.

10. An apparatus as set forth in claim 9 wherein said first portion of said conductor terminal has a width which is less than the width of said second portion of said conductor terminal.

11. An apparatus as set forth in claim 10 wherein said opening in said circuit board has an insertion portion and an attachment portion, the width of said insertion portion of said opening being greater than the width of said attachment portion of said opening.

12. An apparatus as set forth claim 11 wherein the width of said second portion of said conductor terminal is less than the width of said insertion portion of said opening in said circuit board and is greater than the width of said attachment portion of said opening in said circuit board.

13. An apparatus as set forth in claim 11 wherein said conductor terminal is movable relative to said circuit board from a first position in which said first portion of said conductor terminal is disposed in said insertion portion of said opening to a second position in which said first portion of said conductor terminal is disposed in said attachment portion of said opening to establish an electrical connection between said second portion of said conductor terminal and said circuit board.

* * * * *